US005490367A

United States Patent [19]

Lee

[11] Patent Number: 5,490,367

[45] Date of Patent: *Feb. 13, 1996

[54] APPARATUS FOR SUPPORTING AND MOVING VERTICALLY AN ERECTED FORM ASSEMBLY

[76] Inventor: Wen-Yuan Lee, 7F-3, No.8, Lane 390, Sec.1, Chien-Kang Rd., Tainan City, Taiwan

[ * ] Notice: The term of this patent shall not extend beyond the expiration date of Pat. No. 5,329,742.

[21] Appl. No.: 246,312

[22] Filed: May 17, 1994

Related U.S. Application Data

[63] Continuation-in-part of Ser. No. 910,527, Jul. 8, 1992, Pat. No. 5,329,742.

[51] Int. Cl.[6] ..... E04G 11/02

[52] U.S. Cl. ..... 52/749.1; 264/33; 264/34; 249/152; 249/20

[58] Field of Search ..... 249/18, 19, 20, 249/23, 24, 25, 152; 52/749, 749.1; 264/33, 34

[56] References Cited

U.S. PATENT DOCUMENTS

| | | | |
|---|---|---|---|
| 3,275,719 | 9/1966 | Dudson . | |
| 3,900,182 | 8/1975 | Berman et al. | 249/24 |
| 3,993,720 | 11/1976 | Burdett | 249/20 X |
| 4,016,228 | 4/1977 | Schmidt . | |
| 4,036,466 | 7/1977 | Van Meter | 249/18 |
| 4,076,778 | 2/1978 | Whitting . | |
| 4,123,031 | 10/1978 | Hyre | 249/25 X |
| 4,650,150 | 3/1987 | Pacheco-Pifano . | |
| 5,012,627 | 5/1991 | Lundmark . | |
| 5,022,199 | 6/1991 | Horii et al. | 52/123.1 |
| 5,255,489 | 11/1993 | Matsumoto et al. | 52/749 X |
| 5,329,742 | 7/1994 | Lee | 52/743 |

*Primary Examiner*—Carl D. Friedman
*Assistant Examiner*—Christopher Todd Kent
*Attorney, Agent, or Firm*—Joseph W. Berenato, III

[57] ABSTRACT

An apparatus is used to support and move vertically an erected form assembly during the construction of a building with a plurality of stories. The stories include a lower story and an upper story. Each of the lower and upper stories is formed previously with a concrete wall structure that has surrounding walls formed integrally with reinforced horizontal beams which confine an interior space. The apparatus includes a form support body that can extend across the interior space of the upper story and that has a top side on which the erected form assembly can rest. A plurality of legs extend downwardly from the form support body. Each leg has a lower portion associated with a clamping unit in order to fix releasably the leg to one of the reinforced horizontal beams of the lower story. A horizontal support bar is located below and is spaced from the form support body. The horizontal support bar can extend across the interior space of the lower story and has two ends to be mounted releasably on the reinforced horizontal beams of the lower story. A moving unit, which is connected to the form support body and the horizontal support bar, is used for moving vertically the horizontal support bar with respect to the form support body.

3 Claims, 10 Drawing Sheets

APPARATUS FOR SUPPORTING AND MOVING VERTICALLY AN ERECTED FORM ASSEMBLY

CROSS REFERENCE TO RELATED APPLICATION

This is a continuation-in-part application of U.S. patent application Ser. No. 07/910,527, filed on Jul. 8, 1992, now U.S. Pat. No. 5,329,742.

BACKGROUND OF THE INVENTION

1. Field of the Invention

This invention relates to an apparatus for supporting and moving vertically an erected form assembly which is used to construct a building.

2. Description of the Related Art

The copending patent application by the applicant of the present application relates to a process for constructing a concrete building. In addition, a similar method for making a concrete building has been disclosed in U.S. Pat. No. 3,275,719 by Dudson. The method of Dudson comprises the steps of setting up at a building site a construction platform that has vertical forms and horizontal forms, building side walls of concrete, leaving openings at spaced intervals that extend through the side walls as they are formed, placing support platforms through these openings in the side walls, and supporting the construction platform and raising it after the concrete has cured by jacking means resting on and applying load to the support platforms. "Windows" are formed on the side walls, and steel saddles rest in the windows in order to provide mounting anchorage for jacks which are used to move vertically the construction platform. The jacks are generally in pairs so that one jack is always operated to lift the construction platform, while another adjoining jack is positioned at one of the windows by means of one of the saddles when raising or lowering the construction platform. The apparatus used in the method of Dudson in order to move vertically the construction platform does not allow the construction platform to be moved horizontally for contraction or expansion.

SUMMARY OF THE INVENTION

Therefore, the objective of this invention is to provide an improved apparatus for supporting and moving vertically an erected form assembly which is used to construct a building. The apparatus of this invention permits the erected form assembly to be moved horizontally on a form support body such that the erected form assembly can be contracted or expanded as desired when raising or lowering the latter.

Accordingly, an apparatus of this invention is used for supporting and moving vertically an erected form assembly which is used to construct a building that has a plurality of stories. The stories include a lower story and an upper story. Each of the lower and upper stories has a concrete wall structure that has surrounding walls formed integrally with reinforced horizontal beams which confine an interior space therebetween. The apparatus includes a form support body that can extend across the interior space of the upper story and that has a bottom side and a top side on which the erected form assembly can rest. A plurality of legs extend downwardly from the form support body. Each leg has a lower portion associated with a clamping unit in order to fix releasably the leg to one of the reinforced horizontal beams of the lower story. At least one horizontal support bar is located below and is spaced from the form support body. The horizontal support bar can extend across the interior space of the lower story and has two ends to be mounted releasably on the reinforced horizontal beams of the lower story. The apparatus further has means, connected to the form support body and the horizontal support bar, for moving vertically the horizontal support bar with respect to the form support body.

The clamping unit may include a pair of spaced opposite seats projecting outwardly from the lower portion of each leg, and a pair of hydraulic operated clamp members mounted respectively on the seats in order to clamp cooperatively one of the reinforced horizontal beams of the lower story.

The moving means may include a mounting seat which is fixed on the horizontal support bar, and a rack-and-pinion mechanism which is mounted in the mounting seat. The rack-and-pinion mechanism has a pinion which is mounted in the mounting seat and a rack which extends downwardly from the form support body toward the horizontal support bar. The rack is formed with a toothed face to mesh with the pinion.

BRIEF DESCRIPTION OF THE DRAWINGS

Other features and advantages of the present invention will become apparent in the following detailed description of the preferred embodiment, with reference to the accompanying drawings, in which.

DETAILED DESCRIPTION OF THE PREFERRED EMBODIMENT

Figure 1:
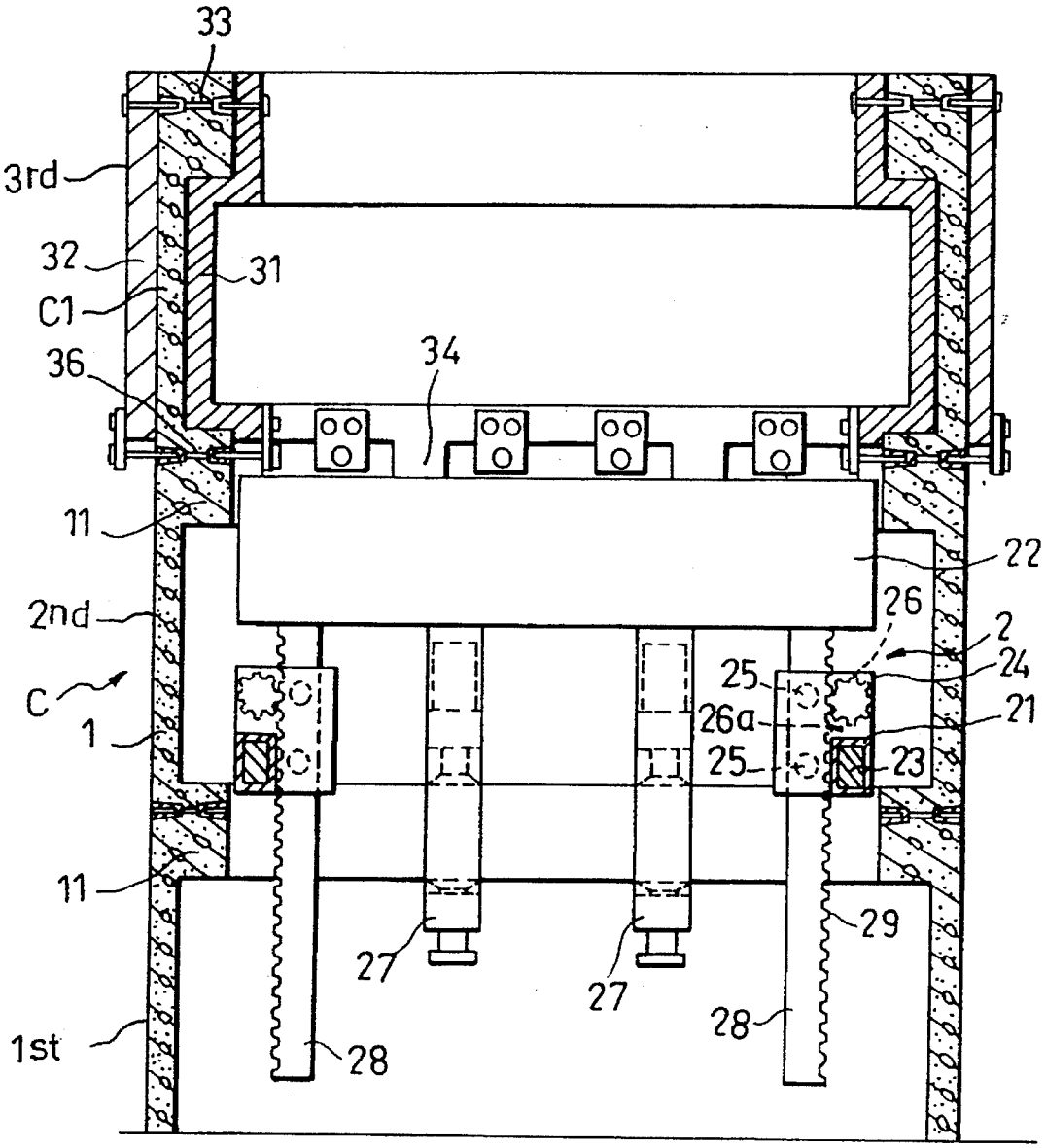
FIG. 1 is a schematic view showing how surrounding walls, reinforced horizontal beams and structural posts for a third floor of a building are constructed.
Figure 2:
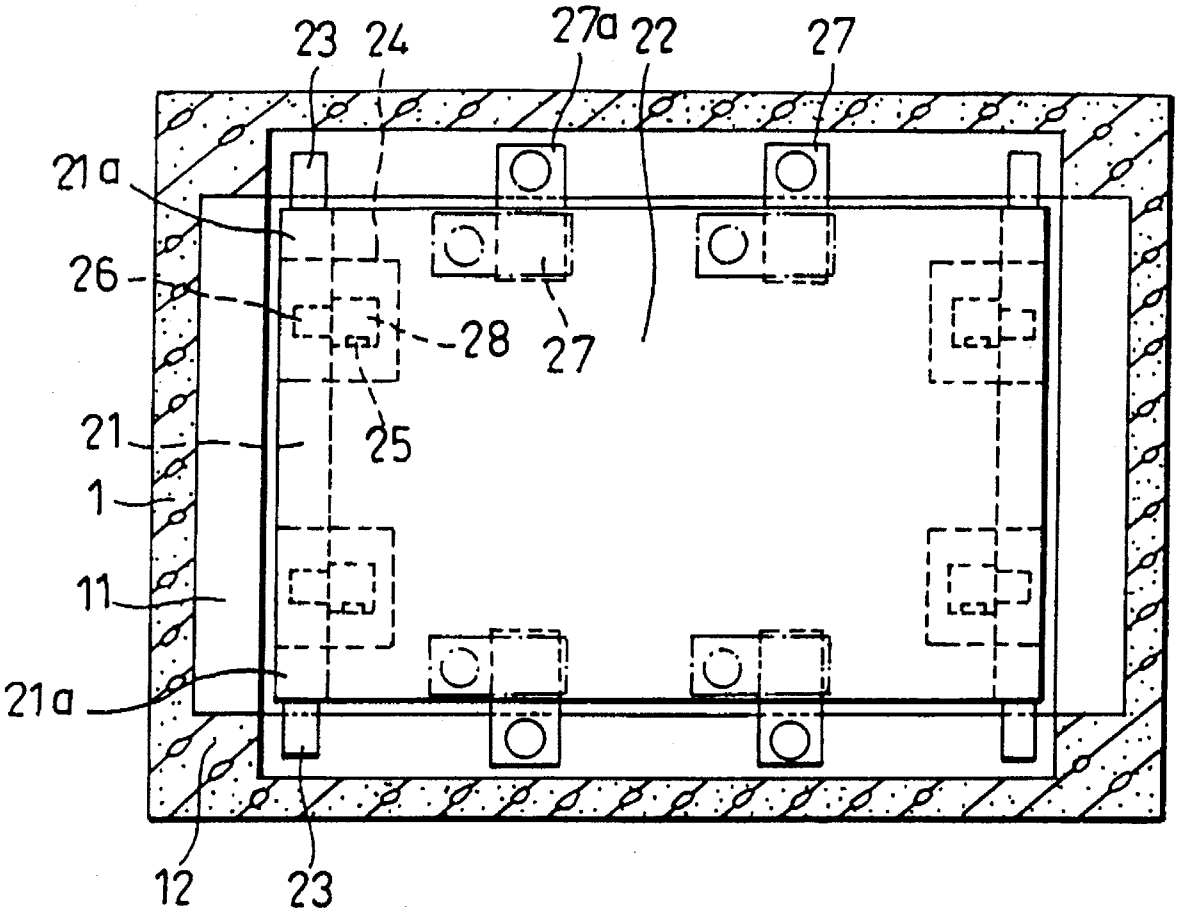
FIG. 2 is a top view showing an apparatus of this invention for supporting and moving vertically an erected form assembly which is used to construct the building.
Figure 3:
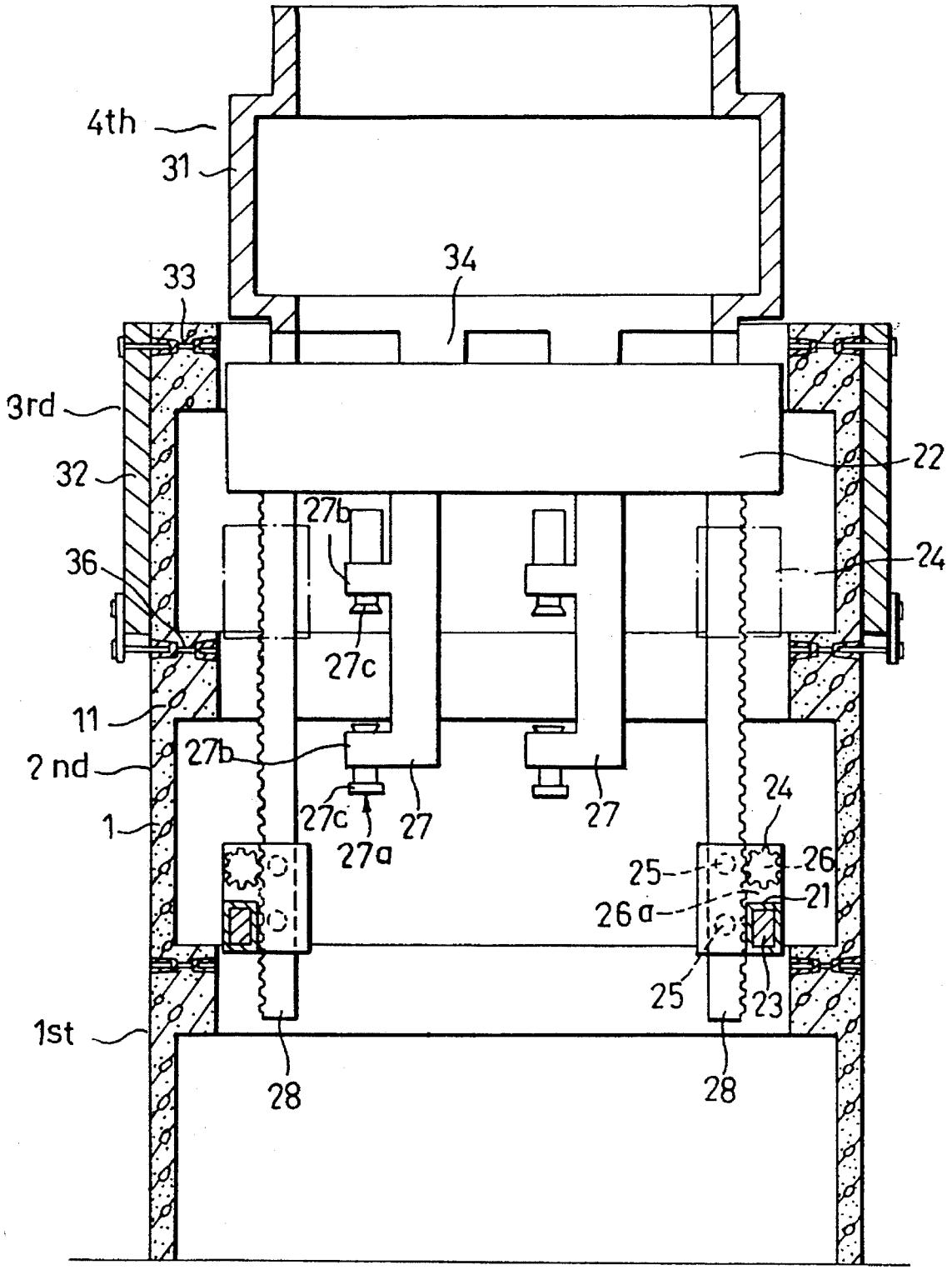
FIG. 3 shows a modular inner form assembly which has been released from the formed surrounding walls and which is moved upwards by the apparatus of this invention.

Referring to FIGS. 1 to 3, an apparatus of this invention is used to support and move vertically an erected form assembly which is used to construct a building. The apparatus includes a form support body 22, a plurality of legs 27 which extend downwardly from the form support body 22, at least one horizontal support bar 21 which is located below and spaced from the form support body 22, and means, connected to the form support body 22 and the horizontal support bar 21, for moving vertically the horizontal support bar 21 with respect to the form support body 22. The form support body 22 has a bottom side and a top side on which the erected form assembly can rest. Each leg 27 has a lower portion associated with a clamping unit (27*a*). The detailed structure of the apparatus will be further described in the following paragraphs.

The building described in this embodiment has ten stories. Referring again to FIGS. 1 to 3, concrete wall structures (C) of first and second stories (1st, 2nd) of the building have been constructed. The concrete wall structure (C) includes surrounding walls 1 formed integrally with reinforced horizontal beams 11 and vertical structural posts 12. The reinforced horizontal beams 11 confine an interior space therebetween. The form support body 22 of the apparatus of this invention is positioned on the level of the second story (2nd) and extends across the interior space confined by the reinforced horizontal beams 11 of the second story (2nd) by means of legs 27 which extend downwardly and clamping units (27*a*) which are associated with the legs 27 to clamp releasably the reinforced horizontal beams 11 of the first story (1st). The form support body 22 can be a trussed frame and has high strength and low weight characteristics. Each clamping unit 27 includes a pair of spaced opposite seats (27*b*) projecting from the lower portion of the leg 27 and a pair of hydraulic operated clamp members (27*c*) respectively mounted on the seats (27*b*) in order to clamp releasably one of the reinforced horizontal beams 11. Referring to FIG. 2, each leg 27 has an upper portion, which is connected pivotally to the bottom side of the form support body 22, and is turnable about a vertical axis between a mounting position in which the seat (27*b*) is shown in solid lines and a released position in which the seat (27*b*) is shown in phantom lines. A pair of horizontal support bars 21 are mounted on the concrete wall structure (C) of the first story (1st). Each horizontal support bar 21 extends across the interior space confined by the reinforced horizontal beams 11 of the first story (1st) and is provided with a hydraulic operated retractable mounting member 23 on two ends thereof in order to mount the same releasably on the reinforced horizontal beams 11 of the first story (1st). The moving means of the apparatus of this invention has two mounting seats 24 fixed on each horizontal support bar 21, and a rack-and-pinion mechanism (26*a*) and two rollers 25 mounted in each mounting seat 24. The rack-and-pinion mechanism (26*a*) includes a pinion 26 and a rack 28. The rack 28 extends downwardly from the bottom side of the form support body 22 toward the horizontal support bar 21 and has a toothed face 29 to mesh with the pinion 26 and a longitudinal sliding groove for receiving the rollers 25 therein. A supporting frame 34 is mounted on the form support body 22 to hold a modular inner form assembly 31 of the erected form assembly thereon. The modular inner form assembly 31 is set up in a molding position. A modular outer form assembly 32 is set up in a cooperative relationship with respect to the modular inner form assembly 31. An upper connecting means 33 and a lower connecting means 36 are provided to fasten the inner and outer form assemblies 31, 32. Concrete is poured between the inner and outer form assemblies 31, 32 so as to form a concrete wall structure (C1) of a third story (3rd). The concrete wall structure (C1) includes surrounding walls (1) formed integrally with reinforced horizontal beams 11 and vertical structural posts 12. After the formed concrete wall structure (C1) has cured, the inner form assembly 31 is stripped therefrom. In FIG. 3, the clamping units (27*a*) are released from the reinforced horizontal beams 11 and each leg 27 is turned to the position shown by the phantom lines in FIG. 2 so as to move upward the form support body 22 to the level of the third story (3rd) by the operation of the rack-and-pinion mechanism (26*a*). The form support body 22 is held rigidly with respect to the reinforced horizontal beams 11 of the third story (3rd) by positioning the legs 27 in the mounting position and clamping the reinforced horizontal beams 11 of the second story (2nd) with the use of the clamping units (27*a*). The inner form assembly 31 is set up again in a molding position. The outer form assembly 32 is released from the formed concrete wall structure (C1) of the third story (3rd) and is moved to the level of the fourth story (4th). The outer form assembly 32 is set up again and cooperates with the inner form assembly 31 to form a concrete wall structure for the fourth story (4th). The length of the rack 28 is substantially equal to the height of two stories. After the concrete wall structure (C1) of the fourth story is formed, the horizontal support bars 21 are released from the reinforced horizontal beams 11 of the first story (1st) by retracting the mounting members 23. The horizontal support bars 21 associated with the mounting seats 24 are moved upward to the level of the second story (2nd), as shown by the phantom lines in FIG. 3, by the rack-and-pinion mechanisms (26*a*) and are then positioned on the reinforced horizontal beams 11 of the second story (2nd) by the mounting members 23. Afterwards, the clamping units (27*a*) are released from the reinforced horizontal beams 11, and the form support body 22 is further moved upward to the level of a fifth story. Therefore, by repeating the above described process, the concrete wall structure of an upper story can be formed after the concrete wall structure of a lower story is formed. Finally, the concrete wall structure of an uppermost story of this building is formed.

Like elements are indicated by the same reference numerals throughout the disclosure.

Figure 4:
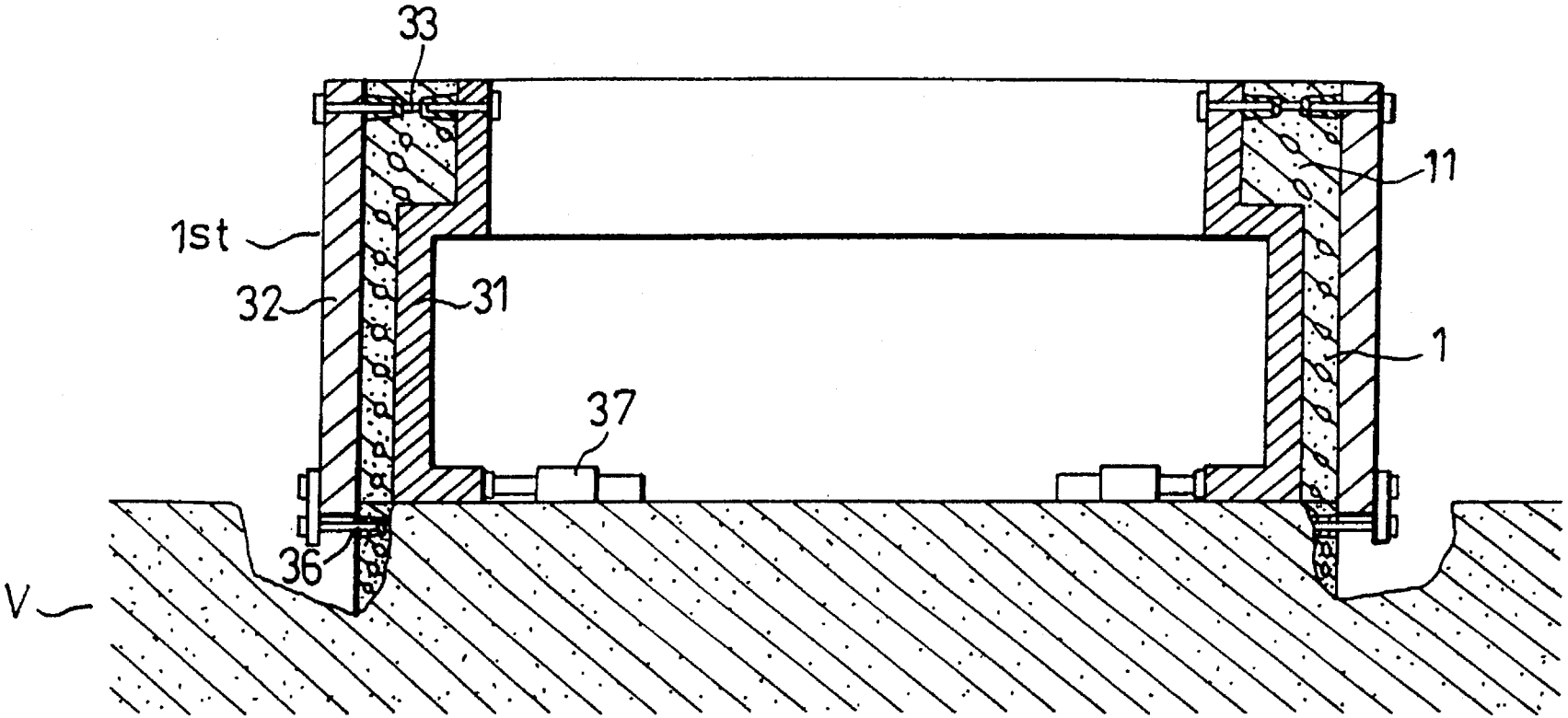
FIG. 4 is a schematic view showing the construction of concrete wall structure of a first floor of the building.
Figure 5:
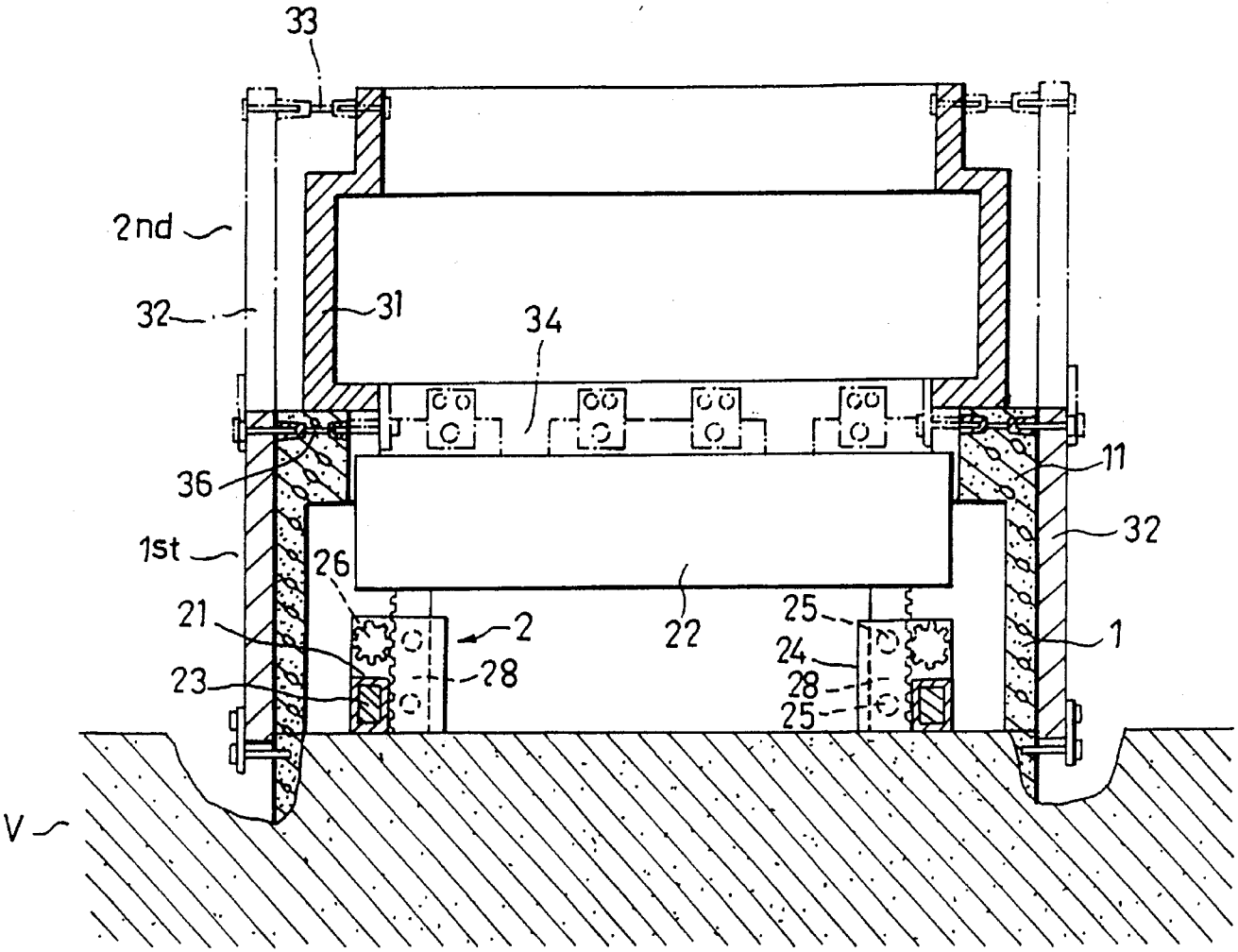
FIGS. 5 and 6 show how to mount the apparatus of this invention onto the building.
Figure 6:
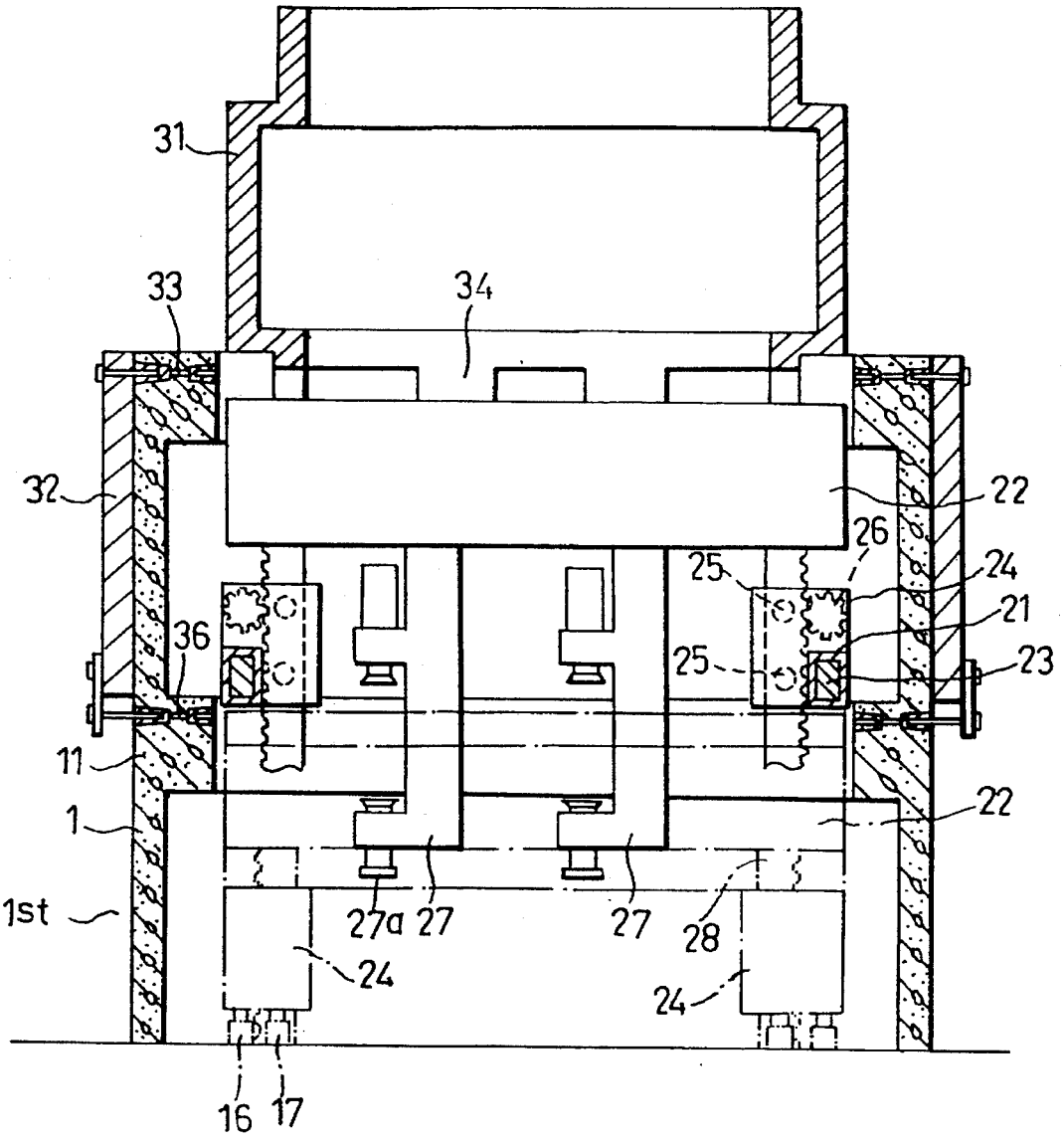

FIG. 4 shows the construction of the first story (1st) using the modular inner form assembly 31 of the erected form assembly and the outer form assembly 32. The modular inner and outer form assemblies 31, 32 are set up above a floor (V) of a basement by the connecting means 33, 36 and a mold supporting and mold releasing apparatus 37 for forming a concrete wall structure (C) of the first story (1st). FIGS. 5 and 6 teach the construction of the second story. Referring to FIG. 5, the form support body 22 is positioned on the level of the first story (1st) and is located in the interior space confined within the reinforced horizontal beams 11 of the first story (1st) by the moving means of the apparatus of this invention which is positioned on the floor (V) of the basement. The modular inner form 31 is supported on the form support body 22 so as to be positioned at the level of the second story (2nd) and is set up in a molding position. The outer form assembly 32 can be moved to the level of the second story (2nd) and is set up in a molding position for concrete pouring. The concrete wall structure of the second story is thus formed. Referring to FIG. 6, a jack means 16 is provided under each mounting seat 24, and a jack means 17 is provided under each rack 28. The mounting seats 24 and the racks 28 of the moving means are lifted upwards by the operation of the jack means 16, 17. The length of each rack 28 is added, while the legs 27 associated with the clamping units (27*a*) are mounted to the form support body 22 for clamping releasably the reinforced horizontal beams 11. It is noted that the length of each rack 28 can be added until the length of the rack 28 is equal to the height of two stories.

Figure 7:
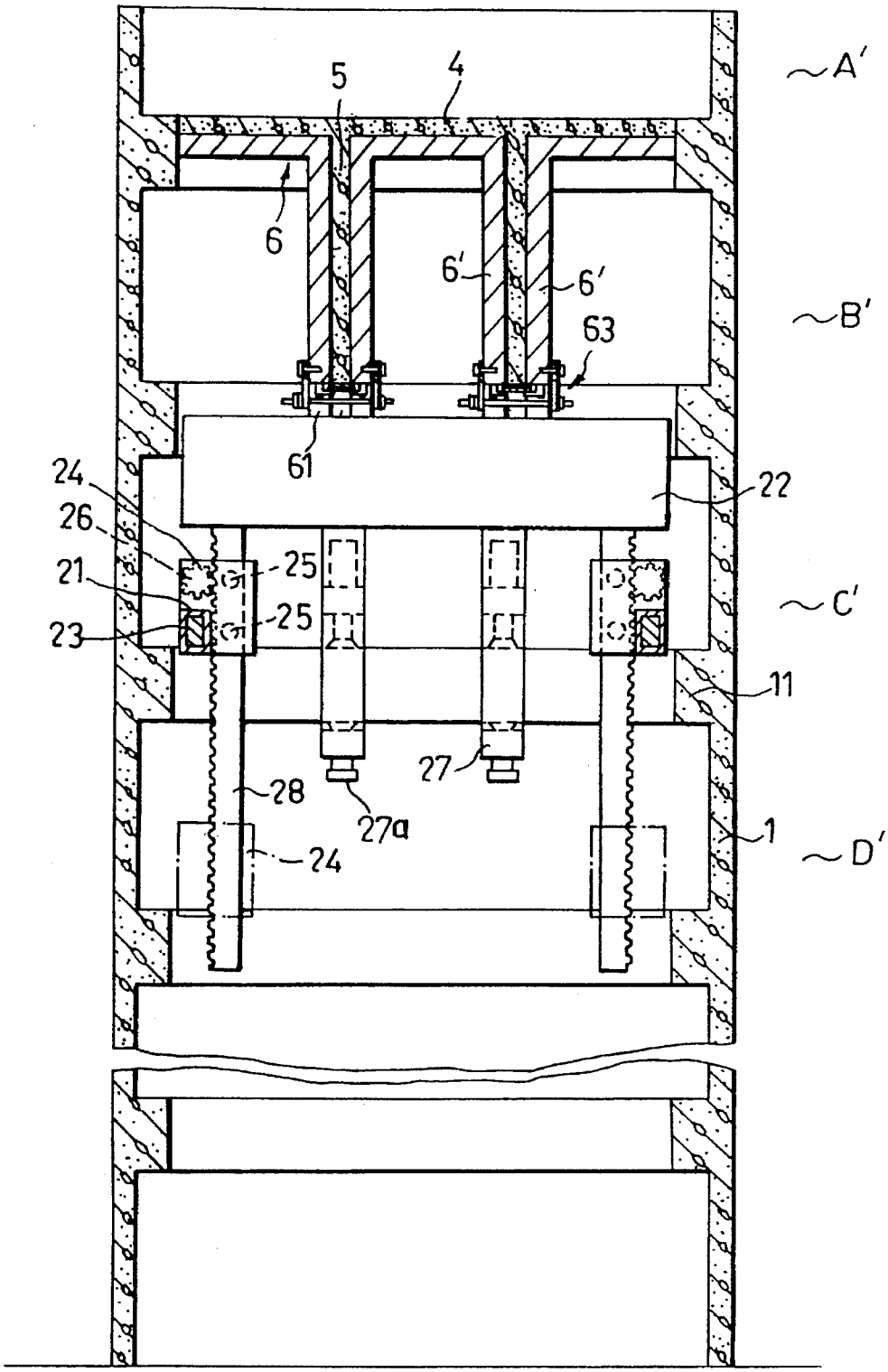
FIG. 7 is a schematic view showing the construction of the floor and partition walls.
Figure 8:
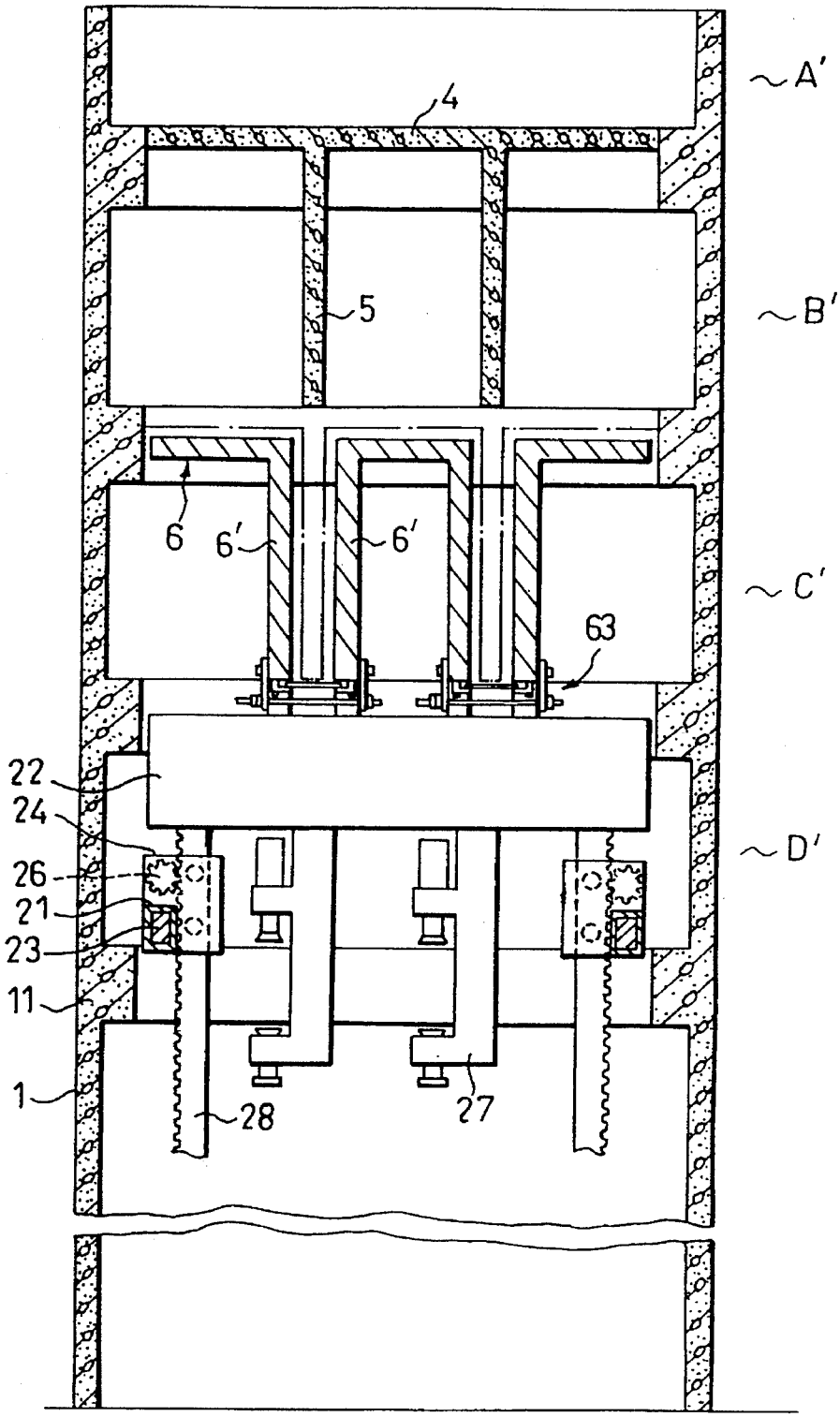
FIG. 8 shows the downward movement of the floor form assembly with the use of the apparatus of this invention.

Referring to FIGS. 7 and 8, after forming the concrete wall structure of a rooftop (A') of the building, the form support body 22 is lowered to the level of the ninth story (C'). A supporting frame 61 is mounted on the form support body 22 in order to hold a floor form assembly 6 of the erected form assembly thereon. The floor form assembly 6 is associated with a form assembly 6' which is used to form partition walls. The floor form assembly 6 is provided with a combined connecting and covering means 63 in order to prevent leakage and to bear the pressure of the poured concrete. The floor form assembly 6 is set up in a molding position, and then a floor 4 and partition walls 5 are formed by pouring concrete into the floor form assembly 6. Referring to FIG. 8, after the concrete has cured, the floor form assembly 6 is stripped from the formed floor 4 and the partition walls 5. The form support body 22 is lowered and positioned on the level of the eighth story (D') by means of the horizontal support bars 21, the moving means and clamping units (27*a*) for the construction of the floor and partition walls of the ninth story (C'). The above operations are repeated to form the floors and partition walls of the building until those of the second story are completed. The floor and partition walls of the first story can be formed later in a conventional manner.

Figure 9:
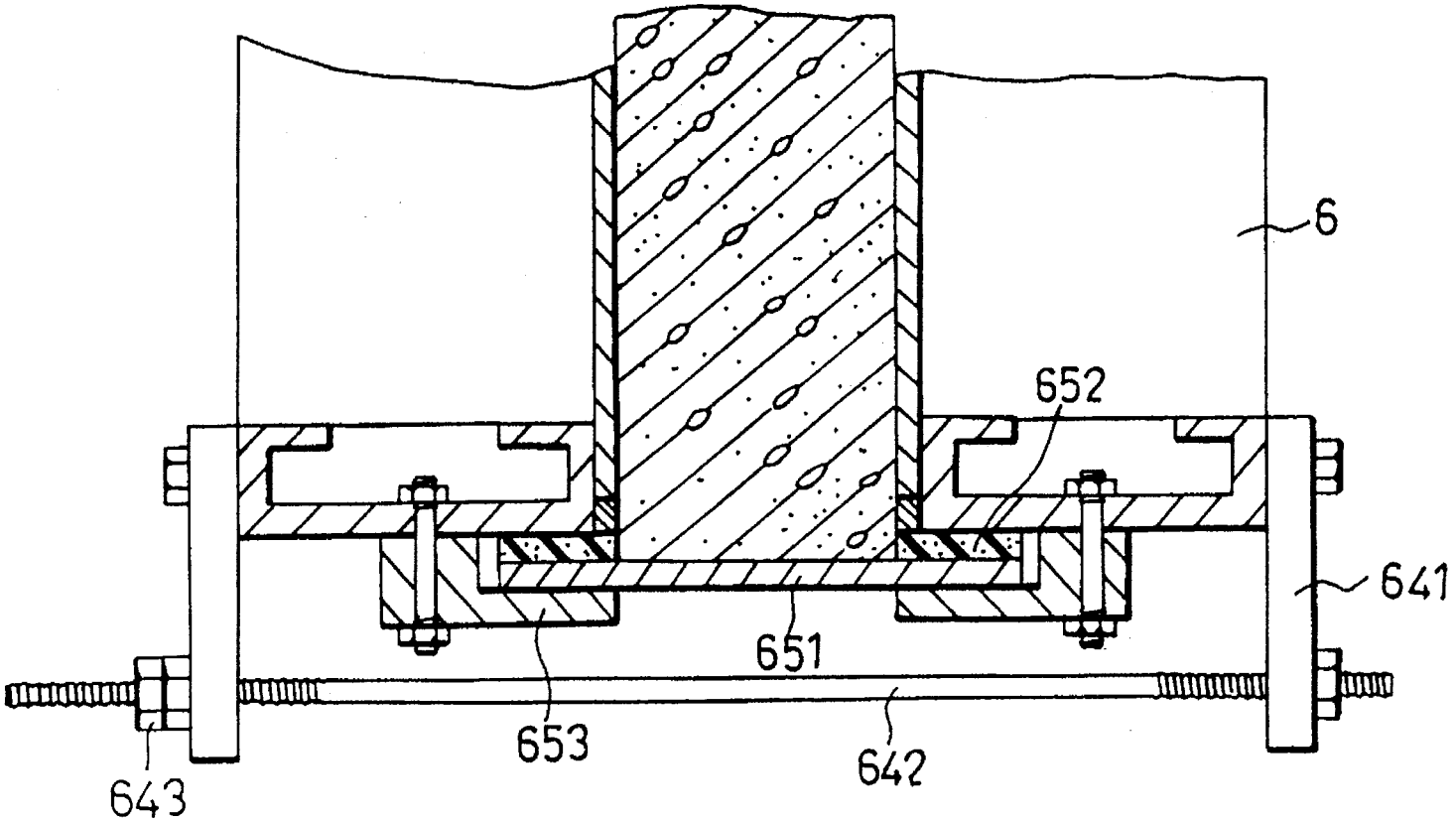
FIG. 9 is a schematic view of a connecting means.
Figure 10:
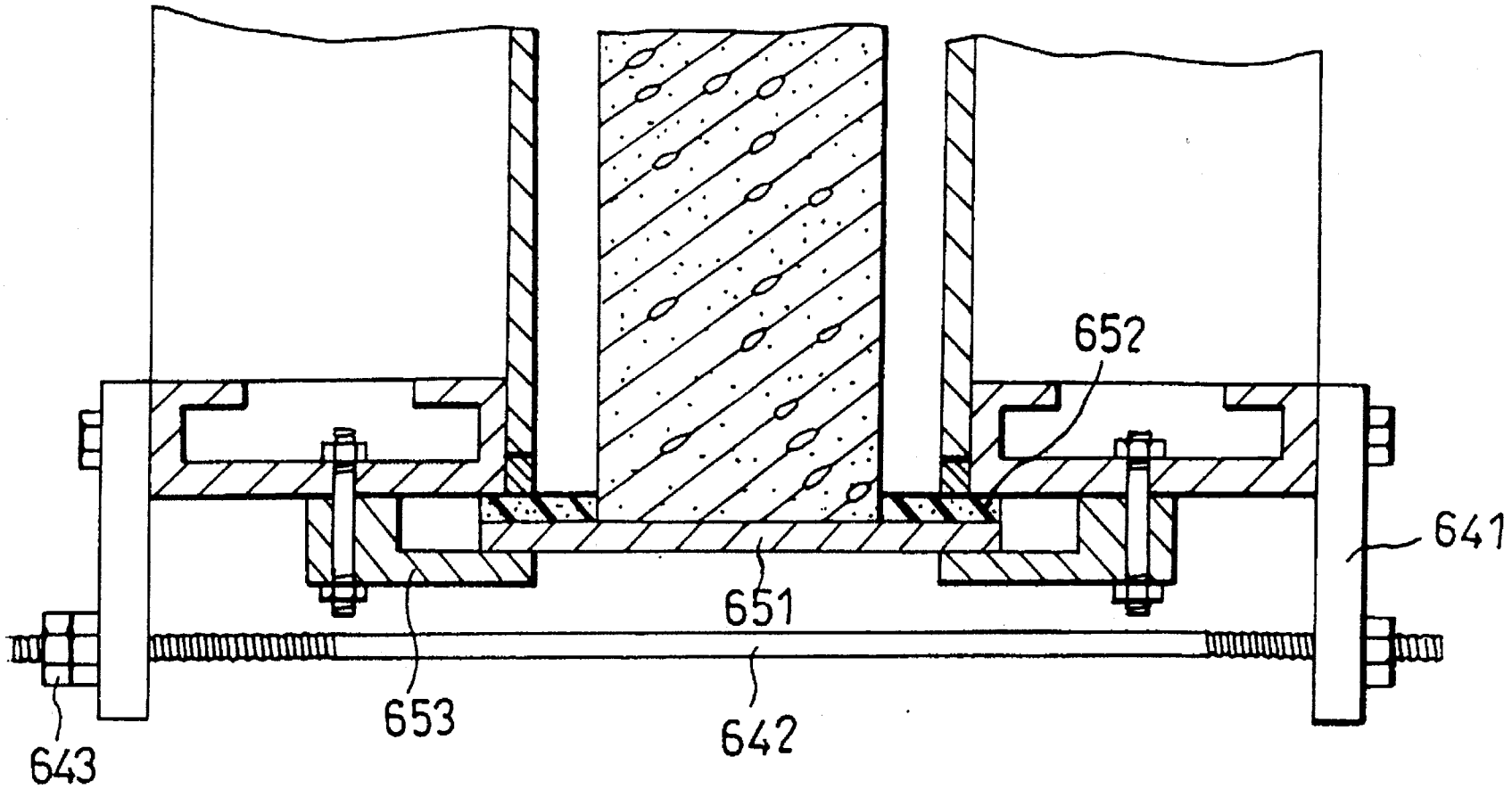
FIG. 10 is a schematic view of the connecting means in FIG. 9 when the floor form assembly is released from the formed floor and the partition walls.

Referring to FIG. 9, the combined connecting and covering means 63 includes two connecting members 641 fixed to the floor form assembly 6 by screws, a rod 642 connected to the connecting members 641 by screws 643, a bearing and covering board 651, and two seats 653 connected to the floor form assembly 6 to retain the board 651. Two elastic members 652 are provided between the floor form assembly 6 and the board 651. Referring to FIG. 10, the combined connecting and covering means 63 are operated to release the floor form assembly 6 from the formed floor and the partition walls 4, 5.

The modular inner form assembly 31 for the concrete wall structure (C) and the floor form assembly 6 for the floor and the partition walls can be used repeatedly without the need for repeated assembly and disassembly. Thus, the concrete walls of each story of the building can be quickly constructed. Since the floor and partition walls are formed one after the other by lowering the floor form assembly 6 from the level of the uppermost story, the construction of the walls can be continued regardless of the weather conditions.

It can be realized that the modular inner form assembly 31 of the erected form assembly can be released from the cured concrete wall structure (C) and is contracted in the horizontal direction by means of the support of the form support body 22, thereby permitting the vertical movement of the modular inner form assembly 31 past the reinforced horizontal beams 11 to an upper or lower floor level. The modular inner form assembly 31 is then expanded on the form support body 22 in the horizontal direction in preparation for a succeeding operation. In addition, with the use of the support and vertical movement of the apparatus of this invention, the floor form assembly 6 can be also contracted and expanded on the form support body 22 in the horizontal direction in a desired floor level for the construction of the floor and the partition walls. Therefore, when the apparatus of this invention is in use, the erected form assembly can be moved horizontally for contraction or expansion and can also be moved vertically to a selected story so as to construct quickly the building.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. An apparatus for supporting and moving vertically an erected form assembly which is used to construct a building with a plurality of stories, said stories including a lower story and an upper story, each of said lower and upper stories being formed previously with a concrete wall structure which has surrounding walls formed integrally with reinforced horizontal beams that confine an interior space therebetween, said apparatus comprising:

a form support body that can extend across said interior space of said upper story and that has a bottom side and a top side on which said erected form assembly can rest;

a plurality of legs which extend downwardly from said form support body, each of said legs having a lower portion associated with a clamping unit in order to fix releasably said leg to one of said reinforced horizontal beams of said lower story;

at least one horizontal support bar which is located below and spaced from said form support body, said horizontal support bar being capable of extending across said interior space of said lower story and having two ends to be mounted releasably on said reinforced horizontal beams of said lower story; and means for moving vertically said horizontal support bar with respect to said form support body, said moving means being connected to said form support body and said horizontal support bar.

2. An apparatus as claimed in claim 1, wherein said clamping unit includes a pair of spaced opposite seats projecting outwardly from said lower portion of each of said legs and a pair of hydraulic operated clamp members mounted respectively on said seats in order to clamp cooperatively one of said reinforced horizontal beams of said lower story.

3. An apparatus as claimed in claim 1, wherein said moving means includes a mounting seat which is fixed on said horizontal support bar, and a rack-and-pinion mechanism which is mounted in said mounting seat, said rack-and-pinion mechanism having a pinion which is mounted in said mounting seat and a rack which extends downwardly from said form support body toward said horizontal support bar, said rack being formed with a toothed face to mesh with said pinion.

* * * * *